US010040281B2

(12) United States Patent
Anderson et al.

(10) Patent No.: US 10,040,281 B2
(45) Date of Patent: Aug. 7, 2018

(54) WIDE ARRAY PRINTHEAD MODULE

(71) Applicant: HEWLETT-PACKARD DEVELOPMENT COMPANY, L.P., Houston, TX (US)

(72) Inventors: Daryl E Anderson, Corvallis, OR (US); George H Corrigan, Albany, OR (US); Scott A Linn, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/519,298

(22) PCT Filed: Oct. 29, 2014

(86) PCT No.: PCT/US2014/062831

§ 371 (c)(1),
(2) Date: Apr. 14, 2017

(87) PCT Pub. No.: WO2016/068900

PCT Pub. Date: May 6, 2016

(65) Prior Publication Data

US 2017/0232734 A1 Aug. 17, 2017

(51) Int. Cl.

| | |
|---|---|
| ***B41J 2/045*** | (2006.01) |
| ***B41J 2/155*** | (2006.01) |
| ***B41J 2/14*** | (2006.01) |

(52) U.S. Cl.

CPC ..... *B41J 2/04541* (2013.01); *B41J 2/0458* (2013.01); *B41J 2/14072* (2013.01); *B41J 2/14112* (2013.01); *B41J 2/155* (2013.01); *B41J 2002/14491* (2013.01); *B41J 2202/13* (2013.01)

(58) Field of Classification Search

CPC .. B41J 2/04541; B41J 2/0458; B41J 2/14112; B41J 2/155; B41J 2/14072; B41J 2002/13; B41J 2002/14491

See application file for complete search history.

(56) References Cited

U.S. PATENT DOCUMENTS

| | | | | |
|---|---|---|---|---|
| 6,529,796 | B1 | 3/2003 | Kroeger et al. | |
| 2002/0070992 | A1 | 6/2002 | Fukano | |
| 2002/0140755 | A1 * | 10/2002 | Hetzer | B41J 2/04528 347/17 |
| 2005/0088465 | A1 * | 4/2005 | Parish | B41J 2/04538 347/5 |

(Continued)

FOREIGN PATENT DOCUMENTS

| | | |
|---|---|---|
| CN | 101456299 | 6/2009 |
| CN | 102781671 | 11/2012 |

(Continued)

OTHER PUBLICATIONS

Dual 13x16 Matrix Head InkJet Driver. ST. Feb 2006. http://www.st.com/web/en/resource/technical/document/datasheet/CD00001743.pdf.

*Primary Examiner* — Sharon A Polk
(74) *Attorney, Agent, or Firm* — Fabian VanCott

(57) ABSTRACT

A wide array printhead module includes a plurality of printhead die. Each of the printhead die includes a number of sensors to measure properties of a number of elements associated with the printhead die. The wide array printhead module further includes an application specific integrated circuit (ASIC) to command and control each of the printhead die. The ASIC is located off any of the printhead die.

13 Claims, 8 Drawing Sheets

(56) References Cited

U.S. PATENT DOCUMENTS

| | | | | |
|---|---|---|---|---|
| 2005/0242980 | A1 | 11/2005 | Collins et al. | |
| 2006/0164455 | A1 | 7/2006 | Silverbrook et al. | |
| 2006/0274103 | A1 | 12/2006 | Kim | |
| 2007/0229566 | A1 | 10/2007 | Takabayashi et al. | |
| 2007/0291081 | A1 | 12/2007 | Kanno et al. | |
| 2012/0120138 | A1 | 5/2012 | Banerjee et al. | |
| 2012/0212535 | A1 | 8/2012 | Sethne et al. | |
| 2014/0204148 | A1 | 7/2014 | Ge et al. | |
| 2015/0062218 | A1* | 3/2015 | Abello Rosello .... | B41J 2/04541 347/10 |
| 2015/0273848 | A1* | 10/2015 | Ge ..... | B41J 2/17566 347/7 |

FOREIGN PATENT DOCUMENTS

| | | |
|---|---|---|
| CN | 103619605 | 3/2014 |
| EP | 1078752 | 2/2001 |
| EP | 1232867 | 8/2002 |
| JP | 2008-126623 | 6/2008 |
| JP | 2011-510850 | 4/2011 |
| JP | 2013-536775 | 9/2013 |
| JP | 2016-501138 | 1/2016 |
| WO | WO2014084843 | 6/2014 |

* cited by examiner

WIDE ARRAY PRINTHEAD MODULE

BACKGROUND

Printing devices provide a user with a physical representation of a document by printing a digital representation of a document onto a print medium. The printing devices include a number of printheads used to eject ink or other printable material onto the print medium to form an image. Printheads deposit ink droplets onto the print medium using a number of resistive elements within printhead die of the printheads.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1A:
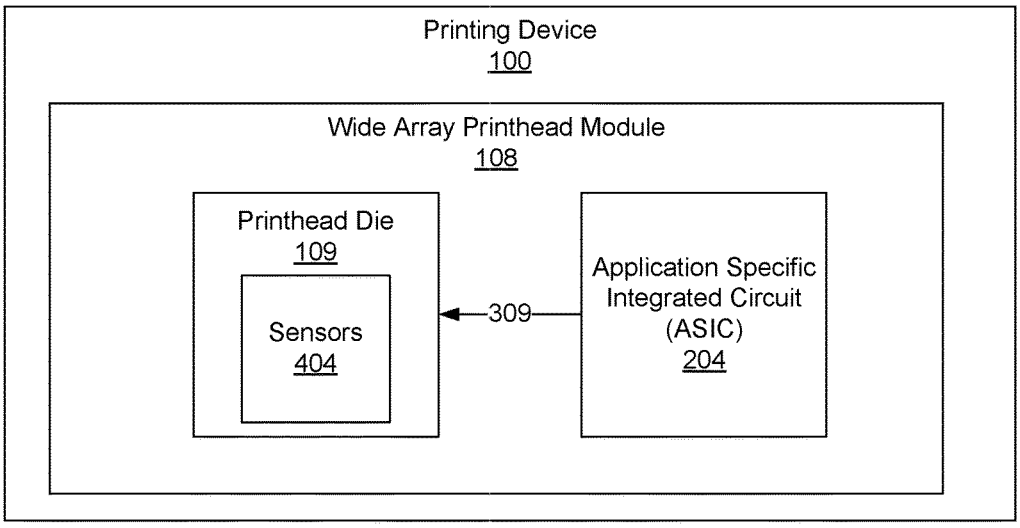
FIG. 1A is a diagram of a printing device including printhead property control circuitry for measuring and controlling a number of properties of a wide array printhead module, according to one example of the principles described herein.

As the resistive elements within the printhead die of the printheads produce heat it may be desirable to rapidly and accurately measure and control the a number of parameters of multiple printhead die within a printhead module, such as a wide array print module. These parameters include, for example, temperature, printhead die integrity (e.g., whether the printhead die is cracked), or other parameters associated with the printhead die.

For example, it may be desirable to rapidly and accurately measure the temperature of a printhead die to determine if the printhead die has a uniform temperature throughout. In one example, the temperature of a number of zones within the printhead die may be determined. A zone may be defined as a portion within a single printhead die that makes up less than the total of the printhead die. In one example, three zones may be defined within the printhead die; a middle zone and two end zones.

Examples described herein determine if a printhead die or a number of zones within the printhead die are to be heated, or if is to be deactivated to achieve a uniform temperature throughout the length of the printhead. In some scenarios, there may be temperatures droops within a printhead die where more heat and higher temperatures exist in the middle of the printhead die and relatively less heat on the ends of the printhead die. This may occur because a printhead has a defined length where heat dissipates at the ends.

Further, with respect to an entire printhead, the printhead die that are located on the ends of a printhead may be more thermally conductive with respect to the substrate of the printhead. Still further, printhead die towards the end of a printhead include wire bonds that allow heat to dissipate from the ends more effectively than in the middle where heat may build up.

If the temperature is not uniform throughout a printhead die, then ink droplet size is negatively affected, as droplet size has a correlation to temperature of the ink and the nozzles within a printhead die. Further, non-uniform temperatures within a printhead die may lead to the occurrence of light area banding (LAB) where an area of the print medium is to be printed with an even flat color, but the printhead produces visibly lighter bands of deposited ink at the edges of the area a given printhead die has printed. This occurs when the ends, for example, of a printhead die are cooler than the middle. Still further, if the ends of a printhead die are cooler than the middle, this may also lead to thin white zones being created at the ends of an area printed by that printhead die.

Even still further, if each printhead die is not maintained at approximately the same temperature relative to other printhead die, the printhead die produce striping where one printhead die prints slightly lighter than another printhead die creating stripes in the printed medium. If, for example, two printhead die within the printhead have a temperature that differs by half a degree or one degree Centigrade, this may produce striping on the printed medium.

Examples described herein use measurement and control circuitry to continually measure the temperature of entire printhead and zones within a number of individual printhead die. The measurement and control circuitry may be collectively referred to as printhead property control circuitry. In one example, the printhead property control circuitry increases the heat in a first number of zones of a printhead die such as the ends of the printhead die, decreases the heat in a second number of zones such as the middle of the printhead die, or both. This brings about a uniform temperature within a printhead die. Other properties of individual printhead may be measured and controlled using the printhead property control circuitry.

Measurement and control circuitry may utilize significant space on printhead silicon and is therefore costly. Some printhead arrays may include printhead die with fully contained temperature measurement and control circuitry. In this arrangement, a printhead module with fifteen printhead die include fifteen sets of temperature measurement and control circuitry; one for each printhead die. The measurement and control circuitry occupy significant space on each printhead silicon of each printhead die. This equates to a significant cost in materials, design, and manufacturing.

Examples described herein provide for a way to dramatically reduce the costs associated with printhead die manufacturing. A printhead may include a single application specific integrated circuits (ASICs) that is connected to multiple separate printhead die. This configuration assists in reducing cost in manufacturing a printhead.

Each printhead die within the printhead may include a number of firing resistors and a number of temperature sensors. The ASIC includes an analog-to-digital converter (ADC) connected to the temperature sensors. Control logic on the ASIC and the ADC control and read a number of resistors coupled to the temperature sensors, respectively, in a time multiplexed manner. Thus, examples described herein provide fast and accurate measurement and control of the parameters such as temperature and printhead die integrity of each printhead die at a minimal cost.

As used in the present specification and in the appended claims, the terms "printhead property," "printhead die property," "property" or similar language is meant to be understood broadly as any physical property of a printhead or a printhead die. In one example, the property of the printhead or printhead die may be a temperature of the printhead or printhead die. Another property includes printhead die integrity that indicates the structural integrity of a printhead die such as whether the printhead die includes a crack or other defect.

Even still further, as used in the present specification and in the appended claims, the term "a number of" or similar language is meant to be understood broadly as any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Turning now to the figures, FIG. 1A is a diagram of a printing device (100) for measuring and controlling a number of properties of a wide array printhead module (108), according to one example of the principles described herein. The printing device (100) may include a wide array printhead module (108). The wide array printhead module (108) includes a number of printhead die (109). In one example, the wide array printhead module (108) includes a plurality of printhead die (109).

Each printhead die (109) includes a number of sensors (404). In one example, each printhead die (109) includes a plurality of sensors (404). The sensors (404) measure properties of a number of elements associated with the printhead die such as, for example, temperature of the elements or integrity of the printhead die (109).

The wide array printhead module (108) further includes an application specific integrated circuit (ASIC) (204). The ASIC (204) controls the sensors (404) to measure the properties of the elements of each of the printhead die (109). The ASIC (204) is located off of any of the printhead die (109). These and other elements will now be described in more detail in connection with FIGS. 1B through 7.

Figure 1B:
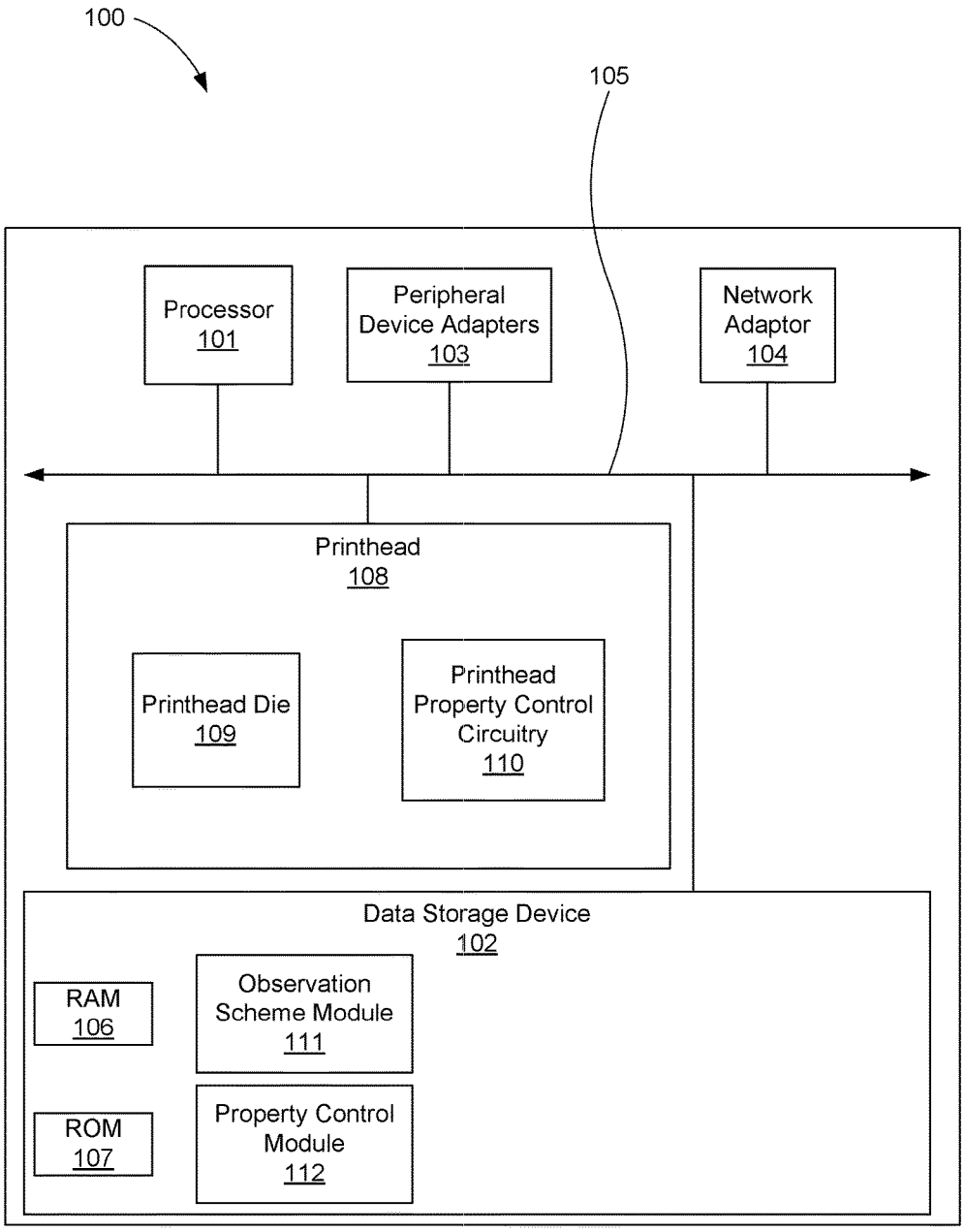
FIG. 1B is a diagram of a printing device including printhead property control circuitry for measuring and controlling a number of properties of a wide array printhead module, according to another example of the principles described herein.

FIG. 1B is a diagram of a printing device (100) including printhead property control circuitry (110) for measuring and controlling a number of properties of a wide array printhead module (108), according to another example of the principles described herein. To achieve its desired functionality, the printing device (100) comprises various hardware components. Among these hardware components may be a number of processors (101), a number of data storage devices (102), a number of peripheral device adapters (103), and a number of network adapters (104). These hardware components may be interconnected through the use of a number of busses and/or network connections. In one example, the processor (101), data storage device (102), peripheral device adapters (103), and a network adapter (104) may be communicatively coupled via a bus (105).

The processor (101) may include the hardware architecture to retrieve executable code from the data storage device (102) and execute the executable code. The executable code may, when executed by the processor (101), cause the processor (101) to implement at least the functionality of determining an observation scheme to observe a number of printhead die within the printhead. The executable code may further cause the processor to, with an ASIC, force a known current through an analog bus connected in parallel to a number of sensing devices on the number of printhead die. The processor, executing the executable code, further instructs a round robin state machine (RRSM) to send a first command embedded in a print data stream or sent via a dedicated control bus to a first printhead die instructing the first printhead die to route the known current from the analog bus through the sensing device on the first printhead die.

The executable code may further cause the processor to observe the voltage from the sensing device on the first printhead die with an ADC on the ASIC, and, with the ASIC, convert the observed voltage to a digital value. The processor, executing the executable code, further compares, with control circuitry on the ASIC, the digital value with a number of thresholds defined within a configuration register. The executable code may further cause the processor to, with the ASIC, send a second command embedded in the print data stream or sent via a dedicated control bus to the first printhead die, and with a data parser on the first printhead die, adjust a parameter of the printhead die based on the comparison of the digital value with the thresholds. The executable code may, when executed by the processor (101), further cause the processor (101) to implement at least the functionality of observing a next printhead die with the RRSM based on the observation scheme.

The functionality of the processor, when executed by the executable code, is on accordance with the methods of the present specification described herein. In the course of executing code, the processor (101) may receive input from and provide output to a number of the remaining hardware units.

The data storage device (102) may store data such as executable program code that is executed by the processor (101) or other processing device. As will be discussed, the data storage device (102) may specifically store computer code representing a number of applications that the processor (101) executes to implement at least the functionality described herein.

The data storage device (102) may include various types of memory modules, including volatile and nonvolatile memory. For example, the data storage device (102) of the present example includes Random Access Memory (RAM) (106) and Read Only Memory (ROM) (107). Many other types of memory may also be utilized, and the present specification contemplates the use of many varying type(s) of memory in the data storage device (102) as may suit a particular application of the principles described herein. In certain examples, different types of memory in the data storage device (102) may be used for different data storage needs. For example, in certain examples the processor (101)

may boot from Read Only Memory (ROM) (107) and execute program code stored in Random Access Memory (RAM) (106).

Generally, the data storage device (102) may comprise a computer readable medium, a computer readable storage medium, or a non-transitory computer readable medium, among others. For example, the data storage device (102) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The hardware adapters (103, 104) in the printing device (100) enable the processor (101) to interface with various other hardware elements, external and internal to the printing device (100). For example, the peripheral device adapters (103) may provide an interface to input/output devices, such as, for example, a display device, a user interface, a mouse, or a keyboard. The peripheral device adapters (103) may also provide access to other external devices such as an external storage device, a number of network devices such as, for example, servers, switches, and routers, client devices, other types of computing devices, and combinations thereof.

The printing device (100) further comprises a number of printheads (108). Although one printhead is depicted in the example of FIG. 1B, any number of printheads (108) may exist within the printing device (100). In one example, the printheads (108) are wide array printhead modules. The printheads (108) may be fixed or scanning printheads. The printheads (108) are coupled to the processor (101) via the bus (105) and receive print data in the form of a print job. The print data is consumed by the printheads (108) and used to produce a physical print representing the print job.

Each printhead (108) comprises a number of printhead die (109). Although one printhead die (109) is depicted in the example of FIG. 1B, any number of printhead die (109) may exist within the printhead (108). In one example, the printhead die are thermal inkjet (TIJ) printhead die. In this example, the printhead die (109) each include circuitry to drive a number of resistive elements within ink firing chambers formed into the printhead die (109). When activated by the driving circuitry, the resistive elements heat up. This resistive heating causes a bubble to form in the ink within the firing chamber, and the resultant pressure increase forces an ink droplet from a number of nozzles fluidly coupled to a firing chamber. Although the present application will be described herein in connection with TIJ printhead die, any type of printhead die may be used in connection with the present systems and methods including, for example, piezoelectric printheads.

Each printhead (108) further comprises printhead property control circuitry (110) to control a number of properties of the printhead die (109) and the printhead as a whole. Although the printhead property control circuitry (110) will be described in more detail below, the printhead property control circuitry (110) observes, detects, and configures a number of physical properties of the printhead die (109). The printhead property control circuitry (110) may use a number of observation schemes to observe, detect, and configure the physical properties of the printhead die (109). These observation schemes may include a round-robin observation method, an adaptive observation method, a depopulation observation method, an active printhead die observation method, a masking observation method, a dependency observation method, a random observation method, or other observation methods described herein.

The printing device (100) further comprises a number of modules used in the implementation of the systems and methods described herein. The various modules within the printing device (100) comprise executable program code that may be executed separately. In this example, the various modules may be stored as separate computer program products. In another example, the various modules within the printing device (100) may be combined within a number of computer program products; each computer program product comprising a number of the modules.

The printing device (100) may include an observation scheme module (111) to, when executed by the processor (101), determine an observation scheme to use during observation of the printhead die. In one example, the observation scheme module (111) may receive instructions from the printing device or other computing device as to what type of observation scheme to use or a definition of the observation scheme to use. The observation scheme module (111), when executed by the processor (101), causes the processor to instruct the printhead property control circuitry (110) to observe and detect a number of physical properties of the printhead die (109).

Any number or type of observation scheme may be used to observe and detect a number of physical properties of the printhead die (109). Choosing which printhead die (109) to analyze and control may be a tradeoff between the computational cost in performing the analysis and control versus need to control that printhead, the printhead die, or a number of zones within the printhead die. Because each sensor is addressed within the printhead or printhead die, any addressing scheme may be created. This addressing scheme may be based on the printhead (108) or printhead die (109), and their respective thermodynamics. Some portions of the printhead (108) or printhead die (109) may be more stable than others. Therefore, the printhead property control circuitry (110) may concentrate readings at portions that are more dynamic such as, for example, the ends of the printhead (108) or printhead die (109). A baseline characteristic for the printhead (108) or printhead die (109) may be created that identifies stable and dynamic portions of the printhead (108) or printhead die (109).

The observation schemes used by the printhead property control circuitry (110) may include a round-robin observation method, an adaptive observation method, a depopulation observation method, an active printhead die observation method, a masking observation method, a dependency observation method, a random observation method, or other observation methods described herein. A round-robin observation method includes analyzing one sensor of a plurality of sensors located on the number of printhead die (109) in a round robin manner where each printhead die (109) is assigned in order, observing and controlling all the printhead die without priority. In another example of a round-robin observation method, every other sensor is observed and then the method loops back to check the alternating sensors skipped. Any permutation or the order of observation of the sensors may be used.

Another example of an observation scheme includes an adaptive observation scheme. The adaptive observation scheme accommodates for different rates of thermal flux on the printhead (108) and printhead die (109). If there exists a situation that prescribes printing in discrete areas of the printhead (108) or printhead die (109) such as for example, one end of the printhead (108) and printhead die (109), at higher or lower concentrations, or other fluctuating properties of a print job, then the printhead property control circuitry (110) decreases observation and control bandwidth in the low heat flux areas of the printhead (108) or zones of the printhead die (109), and increases the observation and control bandwidth in the higher heat flux areas of the printhead (108) or zones of the printhead die (109).

Another example of an observation scheme includes a depopulation method. In a depopulation observation scheme, the printhead property control circuitry (110) may choosing printhead die (109) that have a high fluctuation of temperature or other property while skipping those printhead die that do not change often. In this example, dynamic printhead die (109) are observed more often than relatively static printhead die. This observation scheme allows the method (700) to focus on the portion of the printhead die that has a high fluctuation in the printing process. This allows heat, power, and control time to be optimized. In one example, a history of dynamic and static properties may be created over time from which the printhead property control circuitry (110) uses in determining which printhead die (109) to focus on.

Still another example of an observation scheme includes observation of only printhead die (109) that are actively used in a printing process. In printing, it is possible that a portion including less than all the printhead die may be used during a printing process. For example, in some instances half of the printhead die may be used. In this example, the printhead property control circuitry (110) may focus on only those printhead die (109) involved in the printing process. The heaters or other components of the printhead die (109) may be turned off or deactivated in order not to waste heat, power, and printhead control time.

Yet another example of an observation scheme may include a masking observation scheme. The printing device (100) or other computing device may provide a pattern of printhead die observation. This masking observation scheme may detail how the printhead property control circuitry (110) is to implement the observation and control of the printhead die (109). The masking observation scheme may be based on the parameters of a print job, parameters of the environment where the printing device (100) is located, user input, or other factors.

Yet still another example of an observation scheme may include a dependency observation scheme. Using a dependency observation scheme, the printhead property control circuitry (110) may build in dependencies between the pattern of printhead die (109) observation and control and the way a state machine may function. A state machine is a conceptually abstract machine that can be represented as being in one of a finite number of states and only one state at a time. The state machine may be represented in a mathematical model. The state of the state machine may be changed when initiated by a triggering event or condition. In this example, the dependency observation scheme may chose an order of printhead die (109) observation based on the triggering events or conditions of the state machine.

In still another example of an observation scheme, the order or pattern of printhead die (109) observation may be random. Any other observation scheme may be employed by the printhead property control circuitry (110) to achieve a pattern of observation and control of the printhead die (109) that ensure the printhead die (109) and the printhead (108) as a whole are functioning in a uniform manner. Any combination of the above observation schemes may be used by the printhead property control circuitry (110).

The printing device (100) may further include a property control module (112) to control a number of properties that are observed using the printhead property control circuitry (110) and the observation scheme module (111). The property control module (112), when executed by the processor (101), sends instructions to the printhead property control circuitry (110) to instruct the printhead property control circuitry (110) to control a number of properties of the printhead die (109) based on a number of observations made by the printhead property control circuitry (110).

Figure 2:
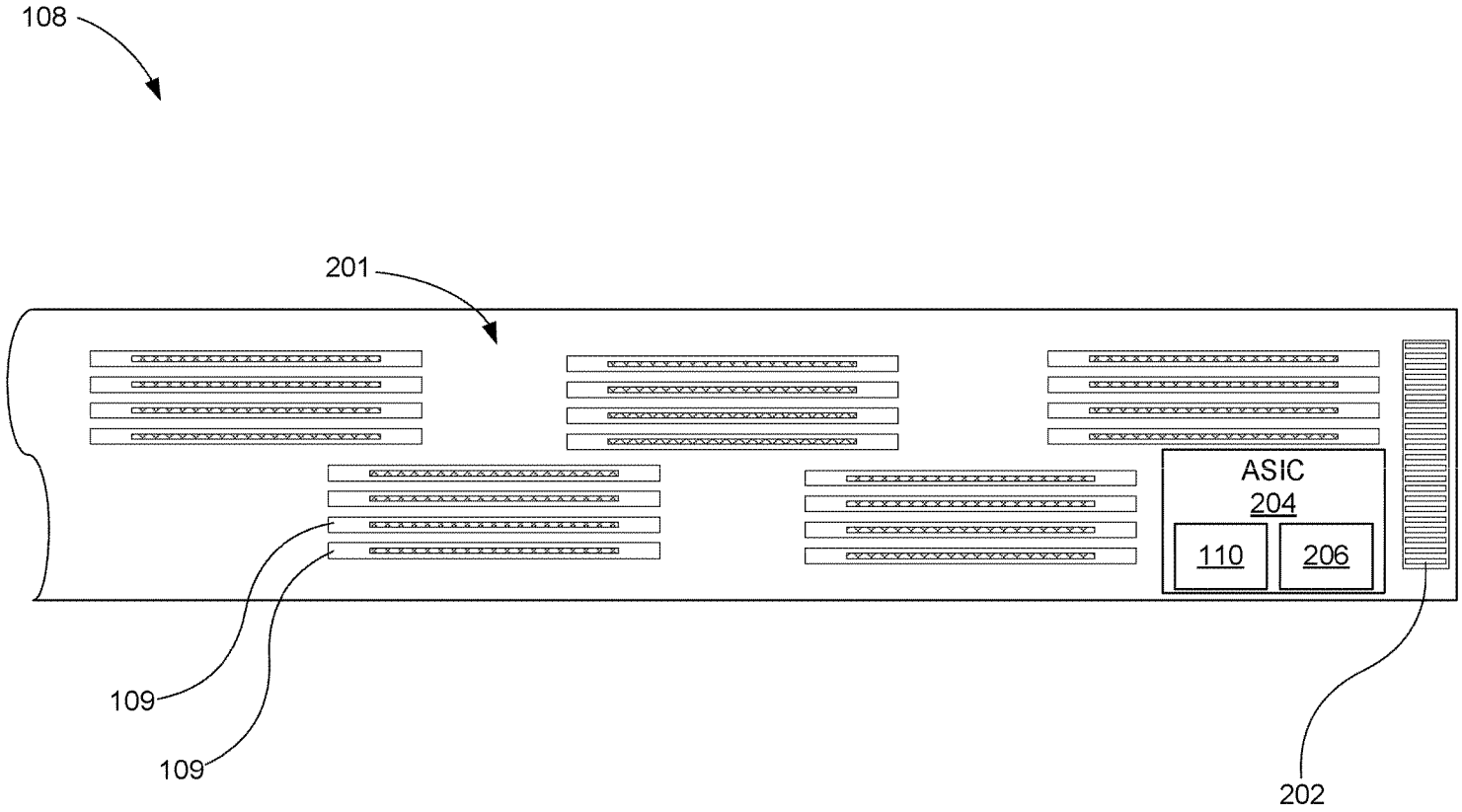
FIG. 2 is a diagram of a wide array printhead module including the printhead property control circuitry of FIG. 1B, according to one example of the principles described herein.

FIG. 2 is a diagram of a wide array printhead module (108) including the printhead property control circuitry of FIG. 1B, according to one example of the principles described herein. The wide array printhead module (108) may include a substrate (201) and a number of electrical connections (202) to facilitate data and power transfer to a number of printhead die (109) coupled to the substrate (201). In some examples, the printhead (108) is covered with a polymer. The polymer insulates electrical contacts and prevents them from contacting the fluid or ink being used in the printhead (108). AS depicted in the example of FIG. 2, the printhead die (109) are organized into groups of four to facilitate full color printing using three colored inks and black ink. In one example, the groups are staggered to allow overlap between columns of nozzles on the printhead die (109). An application specific integrated circuit (ASIC) (204) may be located on the substrate (201) and communicatively connected to each of the printhead die (109) and the electrical connection (202). In one example, the ASIC (204) may be coupled to the substrate (201) in a location between the groups of printhead die (109).

In one example, the printhead (108) may be designed such that it may print an entire page width, eliminating the need for scanning the printhead (108) back and forth over the print media. In the example of FIG. 2, the ASIC (204) may consolidate operations that may otherwise be performed on each of the printhead die (109). In one example, the ASIC (204) controls forty or more printhead die (109) located on the substrate (201) of the printhead (108).

In the example of FIG. 2, the printhead property control circuitry (110) is included within the ASIC (204). In this manner, the ASIC (204) and the printhead property control circuitry (110) control a number of properties of the printhead die (160).

In one example, the printhead (108) includes a printhead memory device (206). In this example, data may be stored on the printhead memory device (206) that assists in the functionality of the printhead property control circuitry (110) as described herein. For example, the printhead memory device (206) may store a number of observation schemes used by the printhead property control circuitry (110) to observe, detect, and configure the physical properties of the printhead die (109). The printhead memory device (206) may store a number of property control limits that define limits of properties of the printhead die (109) that may exist within the printhead die (109). For example, if the property being observed or detected by a sensor is the temperature of the printhead die (109), the printhead memory device (206) may store data related to a high temperature threshold and a low temperature threshold. In this manner, control circuitry may obtain the thresholds, compare a measured temperature value of the printhead with the thresholds, and adjust the temperature of the printhead die (109) by, for example, activate or deactivate a number of heaters located on the printhead die (109) to bring the temperature of the printhead die (109) into the threshold limits.

Figure 3:
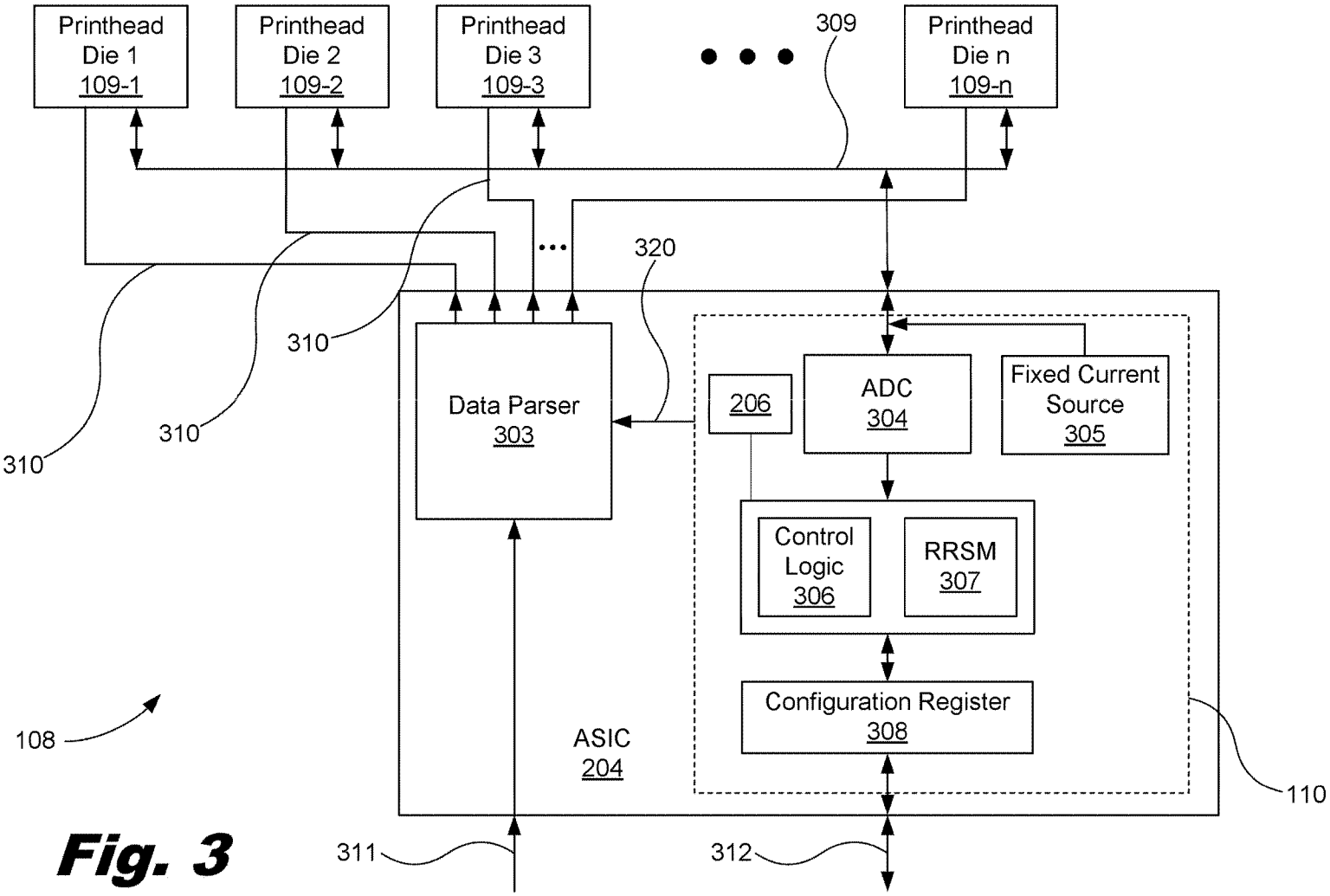
FIG. 3 is a diagram of printhead property control circuitry for a wide array printhead, according to one example of the principles described herein.

FIG. 3 is a diagram of printhead property control circuitry (110) for a wide array printhead (108), according to one example of the principles described herein. The wide array printhead (108) of FIG. 3 includes the ASIC (204). The ASIC (204) is coupled to the electrical connections (FIG. 2, 202) to facilitate data and power transfer to the printhead die (109). The ASIC (204) receives print data from the processor (FIG. 1B, 100), data storage device (FIG. 1B, 102), peripheral device adaptors (103), network adaptor (104), or other elements of the printing device (FIG. 1B, 100) via a print data line (311). The print data is transmitted to a data parser (303) that sends the print data to supply parsed nozzle data to the printhead die (109).

The wide array printhead (108) of FIG. 3 further includes a number of printhead die (109-1, 109-2, 109-3, . . . , **109-*n*) collectively referred to herein as 109. The printhead die (109) are coupled to the data parser (303) of the ASIC (204) via a number of printhead data lines (310**) that transmit print data.

The wide array printhead (108) further includes the printhead property control circuitry (110). The printhead property control circuitry (110) is indicated by box 110 in FIG. 3. By locating one set of printhead property control circuitry (110) on the ASIC (206), and not on individual printhead die (109), the examples described herein provide for a cost effective way for controlling properties of the printhead die (109). The architecture presented in the example of FIG. 3 remove redundant sets of printhead property control circuitry from the printhead die (109). It is otherwise expensive in both materials and manufacturing to include additional elements on a printhead die (109). These additional elements may include respective temperature control servo loops including a number of temperature sensing units, an analog to digital convertor to convert the analog temperature signal to digital, a configuration register set to set temperature control limits in the printhead die (109), control circuitry to compare the digital temperature to the control limits, heater control logic, and heaters.

The examples described herein provide for a higher precision property control circuitry manufactured on the less expensive silicon of the ASIC (204). In the examples described herein, the printhead die (109) includes a number of temperature sensing units, a pass gate (405) and pass gate control logic to communicate signals to the ASIC (204), and a heater and heater control logic. These components consume a relatively smaller amount of area on the silicon of the printhead die (109). Thus, a number of digital and thermal control components including the ADC, configuration register set, and control circuitry to compare the digital temperature to the control limits, among other components are removed off the printhead die (109).

The printhead property control circuitry (110) comprises a number of analog-to-digital converters (ADCs) (304), a fixed current source (305), control logic (306), a round robin state machine (RRSM) (307), a configuration register (308), and a printhead memory device (206). The printhead property control circuitry (110) is coupled in parallel to each of the printhead die (109) via a analog sense bus (309).

The ADCs (304) are connected to a number of temperature sensors within each of the printhead die (109). The temperature sensors within the printhead die (109) control and read a number of resistors coupled to the temperature sensors. An ADC (304) may obtain information from the temperature sensors in a time-multiplexed manner. Analog temperature signals obtained from the temperature sensors in the printhead die (109) are converted by the ADC (304) into digital signals.

In one example, a plurality of ADCs (304) may be implemented within the printhead property control circuitry (110). Depending on a number of printhead die (109) within the printhead (108), the number of zones analyzed within each of the printhead die (109), and the frequency with which each printhead die (109) and their zones are to be observed and controlled, there may be situations where multiple ADCs, and any associated control logic are utilized within the printhead property control circuitry (110). The multiple ADCs (104) may be used in a ping-pong manner where a first ADC (304) is starting a conversion of an observed analog signal defining a property of a first printhead die (109) to a digital value, while a second ADC (304) is finishing a conversion process with respect to a second printhead die (109). In one example of utilizing two ADCs (304), the two ADCs (304) may alternate the use of the analog bus (309) and the printhead property control circuitry (110). As many ADCs (304) as may prove beneficial to the processing of signals within the printhead (108) may be utilized within the printing device (100).

Although only one line or channel is depicted coming from the ADC (304) of the printhead property control circuitry (110) and coupled in parallel to the printhead die (109), any number of lines may be used to multiplex signals sent between the printhead property control circuitry (110) and the number of printhead die (109). Factors that may determine the number of lines or channels used within the analog bus (309) may include the number of printhead die (109) within the printhead (108) and the space available on the printhead (109). As will be described in more detail below, the ASIC (204) sends commands to an individual printhead die (109) through the printhead data lines (310) to turn on one of a number of that printhead die's (109) sensors. The ASIC (204) send this command to one printhead die (109) at a time making that one sensor on that printhead die (109) the only sensor active at that given time.

A fixed current source (305) applies a known current through the analog bus (309) to a number of the printheads (109). The fixed current source (305) is used to stimulate the sensor being observed on its respective printhead die (109). In one example, multiple analog buses (309) may be included within the printhead (108). This may be advantageous if a desired frequency of measurement is higher than can be achieved through using one analog bus (309).

As mentioned above, the sensor excitation method may include any sensor excitation method that may use a shared sense bus model. Apart from applying a known current via the fixed current source (305) as described above, the printhead property control circuitry (110) may use a multiplexed sense voltage. In this example, the sense voltage may be generated internally by the printhead die (109).

In another example, sensor excitation method may include use of a digital pulse width modulation (PWM) signal in connection with each printhead die (109). A modulated pulse train may be sampled from each printhead die (109). In this example, the modulated pulse train may convey the observed property as a function of duty cycle. A duty cycle may be defined as the percentage of one period in which a signal is active, and may be expressed as:

$$D = \frac{T}{P} * 100\% \quad \text{Eq. 1}$$

where D is the duty cycle, T is the time the signal is active, and P is the total period of the signal. A period is the time it takes a signal to complete an on-and-off cycle.

In an example where multiple analog buses (309) are used, each of the number of printheads (109) are divided among the multiple analog buses (309) such that each analog bus (309) does not couple or communicate with a printhead die (109) that is already coupled to another analog bus (309). For example, if two analog buses (309) were included in the example of FIG. 3, each analog bus (309) may divide the number of printhead die (109) into two approximately equal groups. In this way, one current source and analog bus (309) may be settling in preparation for conversion of an analog property signal representing a detected property of the printhead die (109) by the ADC (304). This may occur while the other analog bus (309) is stable and having its current converted by the ADC (304). This allows multiple processes to be performed during the same period of time that may be otherwise prohibitive in a single analog bus system.

Control logic (306) may also be included within the printhead property control circuitry (110). The control logic (306) receives the digital values obtained by the ADC (304) that represent a value associated with a property of the printhead die (109), and compares the digital values to a number of control limits. For example, if the property observed by the printhead property control circuitry (110) was the temperature of a number of zones of a printhead die (109), the control logic (306) compares the temperature to temperature control limits. In this example, the temperature control limits may include a high temperature threshold and a low temperature threshold, for example.

The printhead memory device (206) may be located on the ASIC (204) and coupled to the control logic (306). As described above, the printhead memory device (206) may store a number of property control limits that define limits of properties of the printhead die (109) that may exist within the printhead die (109). The control circuitry may obtain the thresholds, compare a measured property value of the printhead with the thresholds, and adjust the property of the printhead die (109) to bring the property of the printhead die (109) into the threshold limits.

The printhead property control circuitry (110) comprises a configuration register (308) that receives a number of property control limits and observation schemes from a configuration channel (312) used by the printing device (100) to transmit printhead die (109) configuration data. The configuration register may take the place of or work in association with the printhead memory device (206) to store and provide access to the control limits and observation schemes.

A round robin state machine (RRSM) (307) may also be included within the printhead property control circuitry (110). The RRSM (307) determines and executes a number of observation schemes used in observing properties of the number of printhead die (109). These observation schemes may include a round-robin observation method, a depopulation observation method, an active printhead die observation method, a masking observation method, a dependency observation method, a random observation method, an adaptive observation method, other observation methods described herein, or combinations thereof. When observations are to be made with respect to a number of properties of the printhead die (109), the RRSM (307) determines which of the observation schemes to use. In one example, this determination may be based on a user-defined observation scheme that the RRSM (307) is to use. In another example, which observation scheme is used may be determined based on the layout of the number of printhead die (109) within the printhead (108). In still another example, which observation scheme is used by the RRSM (307) may be determined based on historical data relating to properties of the printhead die (109) and use of other types of observation schemes.

In the example of FIG. 3, the first command to observe a number of sensors on the printhead die (109) and the second command to control a number of heaters (404) on the printhead die (109) may be embedded in a print data stream. In this example, the first and second commands are sent from the printhead property control circuitry (110) to the data parser (303) located on the ASIC (204) via transmission line (320). In this manner, these commands may be obtained by the data parser (303), embedded in the print data stream. and sent to the printhead die (109) via the printhead data lines (310).

Figure 4:
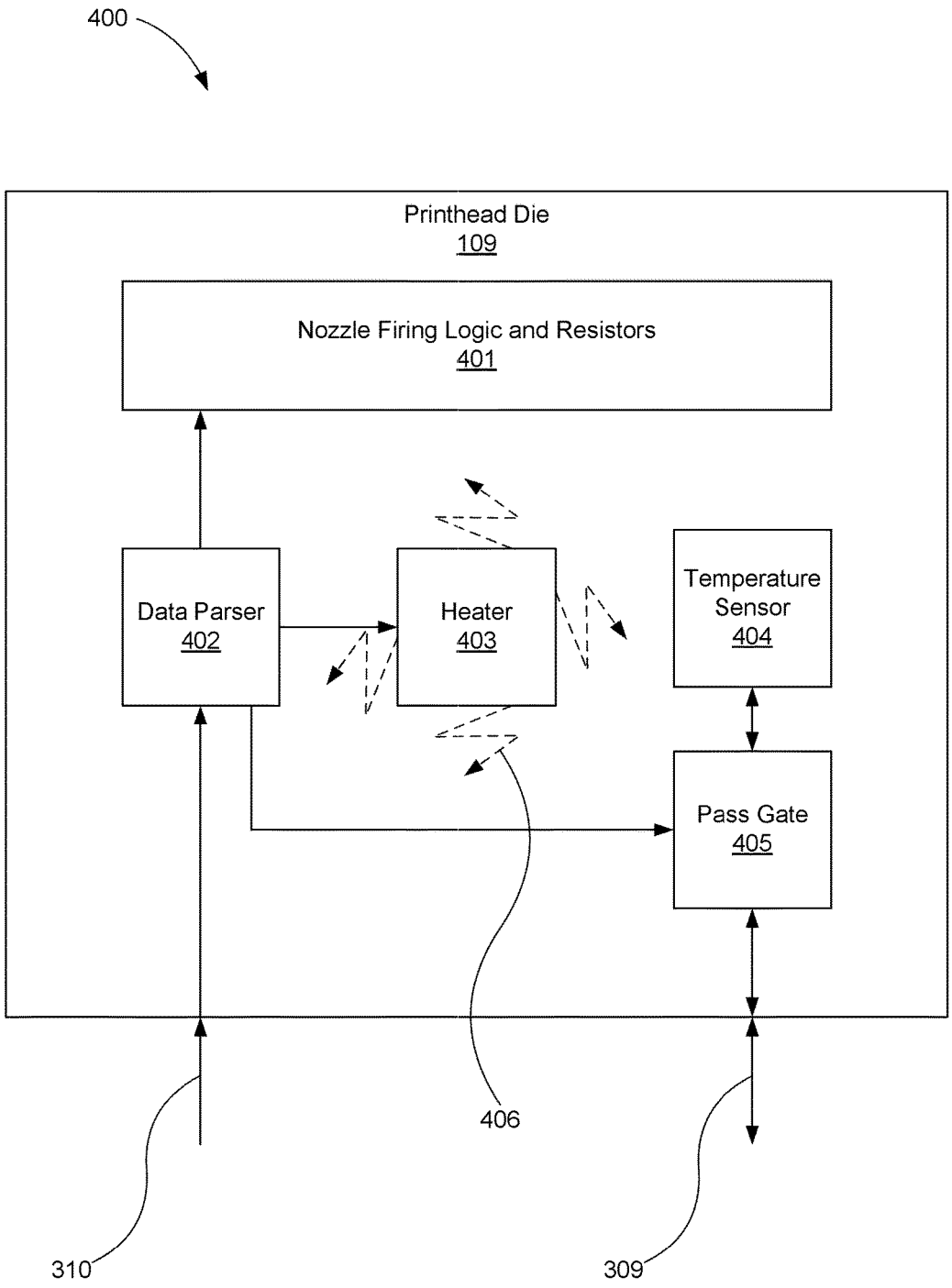
FIG. 4 is a diagram of a printhead die of the printheads of FIG. 3, according to one example of the principles described herein.

FIG. 4 is a diagram of a printhead die (109) of the printheads (108) of FIG. 3, according to one example of the principles described herein. The printhead die (109) includes nozzle firing logic and resistors (401), a data parser (402), a number of heaters (403), and number of temperature sensors (404), and a number of pass gates (405). Print data is transmitted from the data parser (303) of the ASIC (204) via a number of printhead data lines (310) to the printhead die (109) as described above. The analog sense bus (309) transmits a known current supplied by the fixed current source (305) to, in this example, the temperature sensors (404) via the pass gate (405) to obtain an analog signal defining the temperature of the printhead die (109).

In one example, the data parser (402) of the printhead die (109) may be moved to the ASIC (204). In this example, the functions of the data parser (402) may be provided by the data parser (303) located on the ASIC (204). In this example, the data parser (303) located on the ASIC (204) sends print data to supply parsed nozzle data to the nozzle firing logic and resistors (401). This removal of the data parser (402) of the printhead die (109) and utilization of the data parser (303) located on the ASIC (204) decreases costs in the form of materials and manufacturing of the printhead die (109).

In the example of FIG. 4, the data parser (402) of the printhead die (109) receives print data from the ASIC (204), parses the print data to generate parsed nozzle data, and provides the parsed nozzle data to the nozzle firing logic and resistors (401). The data parser (402) may also act as control logic by receiving control commands embedded in the print data stream provided via the printhead data lines (310) or a dedicated control bus. The control commands instruct the data parser (402) to instruct the pass gate (405) to route the current supplied by the fixed current source (305) via the analog sense bus (309) to the temperature sensor (404) to obtain an analog signal defining the temperature of the printhead die (109).

The nozzle firing logic and resistors (401) of the printhead die (109) are used to eject droplets of ink from the printhead die (109) onto a print medium to create a print. The nozzle firing logic and resistors (401) receives the parsed nozzle data from the data parser (402) of the printhead die (109) or the data parser (303) of the ASIC (204).

The heaters (403) are used to control heat within the printhead die (109). In one example, a single heater (403) may be provided on the printhead die (109). In another example, a plurality of heaters (403) are located on different zones within the printhead die (109). In this example, the zones may include a middle zone and two edge zones of the printhead die (109). These three zones provide for uniform temperature control of the printhead die (109). The heaters provide heat to surrounding areas of the printhead die (109) as indicated by 406.

The temperature sensors (404) are used to detect the temperature within the printhead die (109) and provide analog signal defining the temperature to the printhead property control circuitry (110) via the analog sense bus (309). Although a temperature sensor (404) are depicted in the example of FIG. 4, any type of sensor used to detect any property of the printhead die (109) may be used to in the examples described herein. In one example, a plurality of temperature sensors (404) may be included within the printhead die (109). In this example, the plurality of temperature sensors (404) are located on different zones within the printhead die (109). In this example, the zones may include a middle zone and two edge zones of the printhead die (109). These three zones provide for uniform temperature control of the printhead die (109). Further, in one example, the zones of the temperature sensors (404) may match the zones of the heaters (403) described above. In this example, the temperature sensors (404) may readily obtain the temperature in a particular zone, and, through the printhead property control circuitry (110), control the temperature of that particular zone. Although the heaters (403) and temperature sensors (404) are described as being located in the middle and two edges of the printhead die (109) creating three different zones, any number of zones may exist on the printhead die (109).

Figure 5:
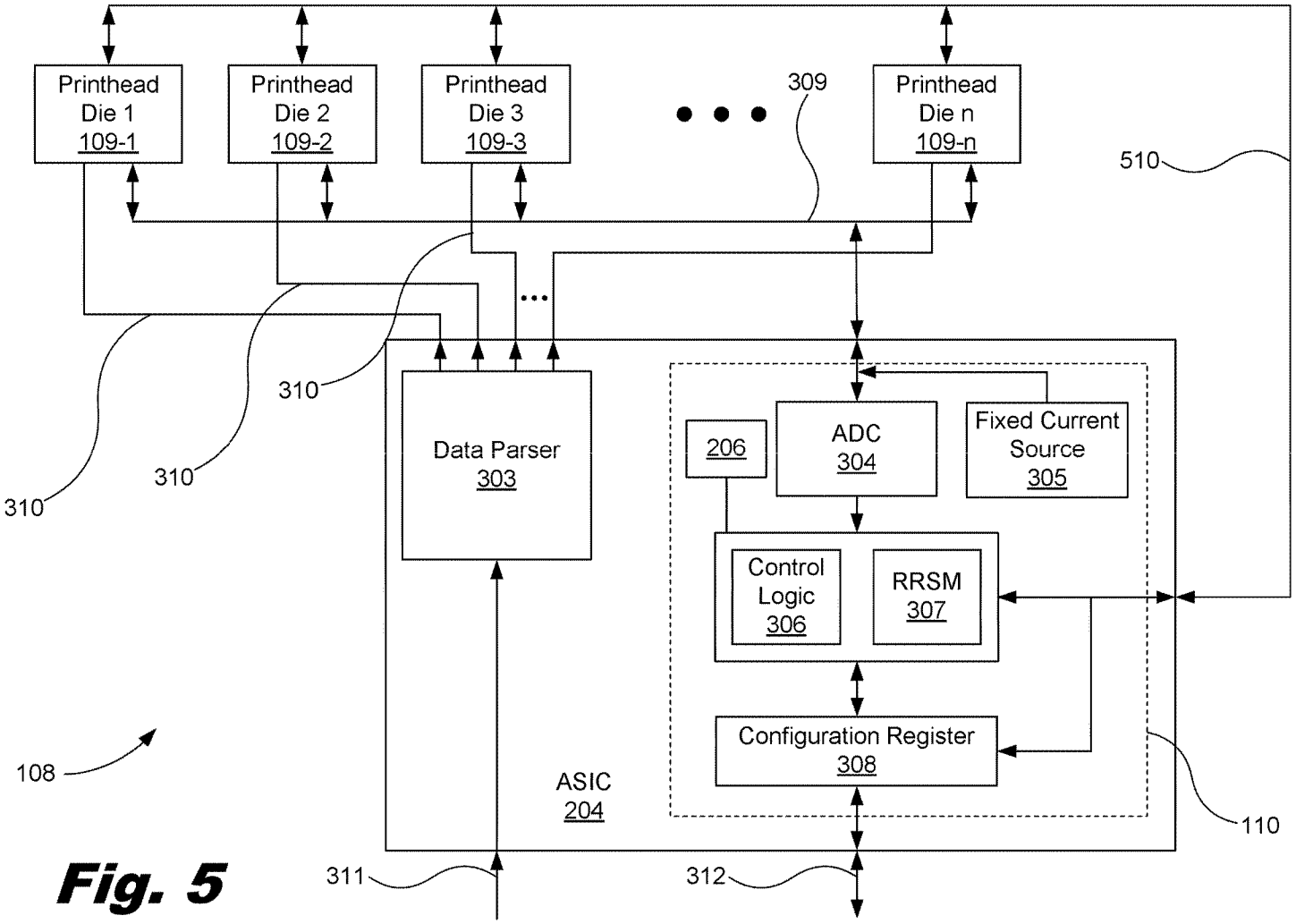
FIG. 5 is a diagram of the printhead property control circuitry for a wide array printhead including a bi-directional configuration bus, according to one example of the principles described herein.

FIG. 5 is a diagram of the printhead property control circuitry (110) for a wide array printhead including a bi-directional configuration bus (510), according to one example of the principles described herein. The printhead property control circuitry (110) of FIG. 5 comprise similar components as described above in connection with FIGS. 3 and 4, and the above description associated with those components is applicable in FIG. 5. FIG. 5 additionally includes the bi-directional configuration bus (510). In the examples of FIGS. 3 and 4, control commands may be sent as embedded signals within a print data stream transmitted from the ASIC (204) to the printhead die (109) via the transmission line (320) and printhead data lines (310). In the example of FIG. 5, the control signals may be sent from the configuration register (308), the control logic (306), and the RRSM (307) to the printhead die (109) via the bi-directional configuration bus (510). Thus, instead of embedding the control commands in the print data stream, the control commands may be sent directly to the printhead die (109. In this example, control commands from the RRSM (307) such as which die is to be observed and controlled, and control commands from the control logic (306) and the configuration register (308) regarding what level to set the heater to, may be transmitted over the bi-directional configuration bus (510). The bi-directional configuration bus (510) may be used for other configuration and control commands in addition to those described herein.

In the example of FIG. 5, the data parser (402) within each of the printhead die (109) may act as control logic by receiving control commands via the configuration bus (510). The control commands instruct the data parser (402) to instruct the pass gate (405) to route the current supplied by the fixed current source (305) via the analog sense bus (309) to the temperature sensor (404) to obtain an analog signal defining the temperature of the printhead die (109) as described above.

Figure 6:
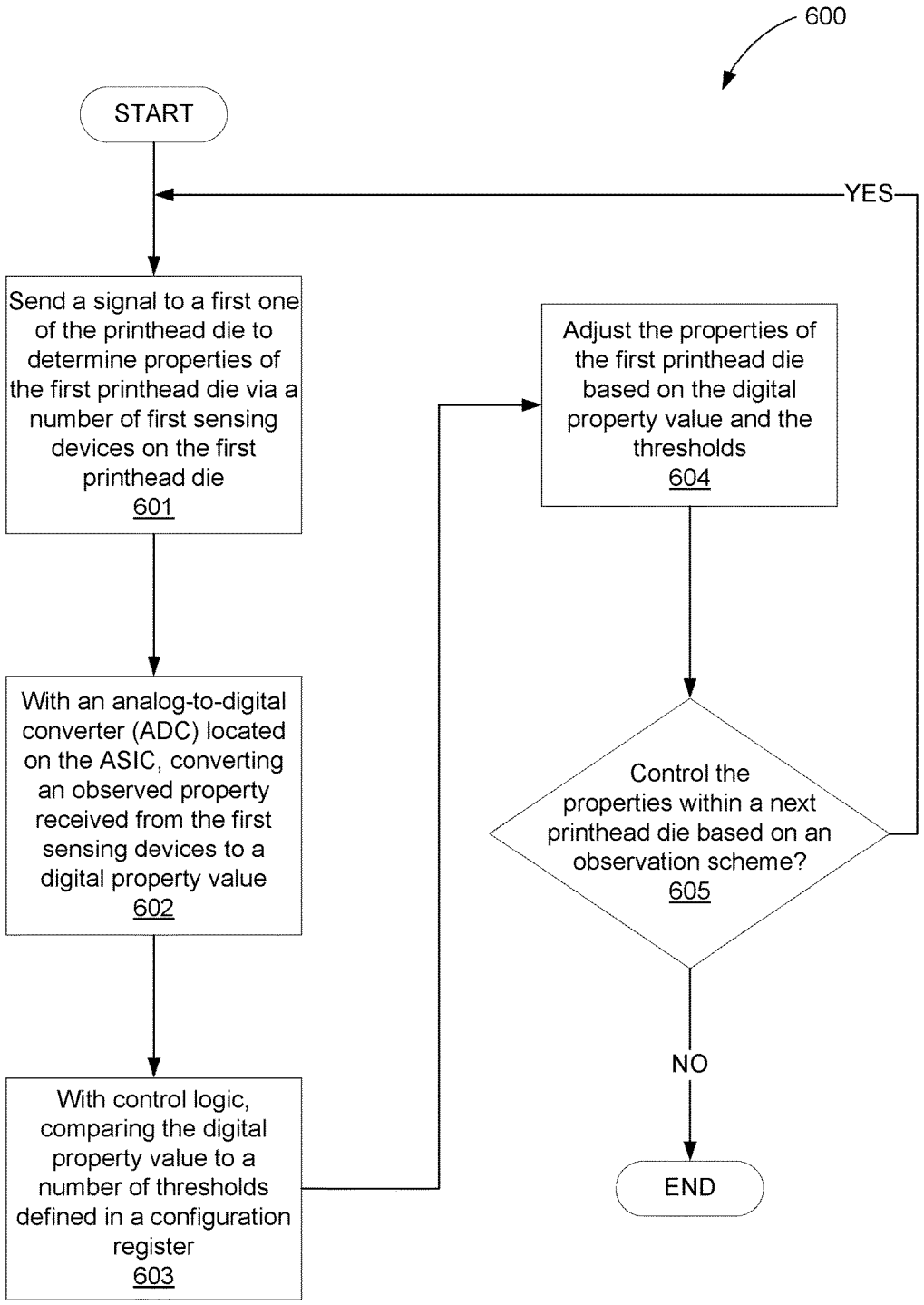
FIG. 6 is a flowchart showing a method of controlling properties within a plurality of printhead die, according to one example of the principles described herein.

FIG. 6 is a flowchart showing a method (600) of controlling properties within a plurality of printhead die (109), according to one example of the principles described herein. Although the example of FIG. 6 is described in the context of temperatures as the property that is being observed and controlled, any type of property associated with the number of printhead die (109) may be observed and controlled.

In one example, the method (600) may be executed by the printing device (100) of FIG. 1B. In another example, the method (600) may be executed by other systems such as the printhead property control circuitry (110). As a result, the functionalities of the method (600) are implemented by hardware or a combination of hardware and executable instructions.

In this example, the method (600) may be performed using a round robin state machine (RRSM) within an application specific integrated circuit (ASIC) located off any of the printhead die. The method (600) includes sending (block 601) a signal to a first one of the printhead die to determine properties of the first printhead die via a number of first sensing devices on the first printhead die, with an ADC on the ASIC. An observed property received from the first sensing devices is converted (block 602) to a digital property value. The method may further include comparing (block 603) the digital property value to a number of thresholds defined in a configuration register using control logic on the ASIC. The properties of the first printhead die may be adjusted (block 604) based on the digital property value and the thresholds. The method may further include, controlling (block 605) the properties within a next printhead die based on an observation scheme.

As mentioned above, the method (600) includes sending (block 601) a signal to a first one of the printhead die to determine properties of the first printhead die via a number of first sensing devices on the first printhead die, with an ADC on the ASIC. In one example, it may be desirable to rapidly and accurately measure the temperature of a printhead die to determine if the printhead die has a uniform temperature throughout. The printhead die may include a number of zones as described above. For example, a printhead die may include a middle zone and two end zones. In this example, temperature sensors may be placed on the printhead die at each of the zones. As a result, the method (600) sends a signal to one of the zones of the printhead die to determine the temperature of the zones within the printhead die. Block 601 may be performed by applying, with the ASIC (204) the information as a known current onto the analog bus (309). However, any sensor excitation method including those described above may be used to send a signal to each of the printhead die.

The analog bus (309) couples the plurality of the printhead die and is connected in parallel with all of the plurality of printhead die. In one example, during sending of the signal to the first printhead die, all other printhead die are disconnected from the analog bus via a number of pass gates associated with each of the printhead die.

Sending (block 601) the signal to the first one of the printhead die to determine properties of the first printhead may include sending the signal over the analog bus (309). The signal may be sent in a time-multiplexed manner relative to the control of other printhead die (109).

As mentioned above, the method (600) further includes, with an ADC located on the ASIC, converting (block 602) an observed property received from the first sensing devices to a digital property value. As mentioned above, the ASIC includes an ADC connected to the temperature sensors that controls and reads a number of resistors coupled to the temperature sensors, respectively, in a time multiplexed manner. The ADC is used to capture an analog signal and produce an equivalent digital signal. In an example, the voltage received from the temperature sensors is an analog signal. The ADC digitally converts the voltage into an equivalent digital signal. In this example, the voltage is converted into a digital temperature value.

The method (600) further includes with control logic, comparing (block 603) the digital property value to a number of thresholds defined in a configuration register. The configuration register (308) may store, in memory, maximum threshold and a minimum threshold for each zone of a printhead die (109) with regard to temperature. For example, if a printhead die (109) includes three zones, the configuration register (308) stores, in memory, maximum thresholds, and minimum thresholds for each of the three zones. In one example, the stored thresholds are stored in the printhead memory device (206). The digital temperature value produced by the ADC for each zone is compared, via the control logic (306), to a maximum threshold and a minimum threshold defined in the configuration register (308). As a result, the method (600) determines if the digital temperature value is below a minimum threshold or above a maximum threshold.

The method (600) further includes adjusting (block 604) the properties of the first printhead die based on the digital property value and the thresholds. If the digital temperature value is below a minimum threshold for a number of zones within the printhead die (109), the zones are to be heated by activating resistive elements such as the heaters (403) within the zone. This adjusts the temperature of the respective zone in the printhead die (109). If the digital temperature value is above a maximum threshold for a number of zones within the printhead die (109), the zones are to be cooled by deactivating resistive elements within the zone. This adjusts the temperature of the respective zone in the printhead die (109). In some scenarios, there may be temperatures droops within the individual printhead die, where more heat and higher temperatures exist in the middle of the printhead die (109) and relatively less heat on the ends of the printhead die. As a result, the method (600) may adjust the temperature at, for example, the end zones more frequently than the middle zone of the printhead die (109). In an example, the temperature of the respective zone in the printhead die is to differ by less than half a degree Centigrade. Thus, the method (600) adjusts temperature of the printhead die (109) such that the temperature is uniform throughout a printhead die. This reduces the negative effects of variations within the ink droplet size, and reduces the occurrence of light area banding (LAB) and striping of the printhead die.

Adjusting (block 604) the properties of the first printhead die (109) based on the digital property value and the threshold may include sending a command to the printhead die to adjust a temperature of at least a portion of the printhead die such as the zones described above. In one example, the command to the printhead die (109) may be sent via a bi-directional configuration bus.

The method (600) includes, with the RRSM (307), controlling (block 605) the properties within a next printhead die (109) based on an observation scheme. As mentioned above, a wide array printhead module includes several printhead die. In one example, the method (600) uses the RRSM (307) to control the temperature of the first printhead die. After the method (600) has controlled the temperature of the first printhead die, as described above, the RRSM controls the temperature of a second printhead die, and continues to a next printhead die (109) based on any observation scheme. As described above, these observation schemes may include a round-robin observation method, an adaptive observation method, a depopulation observation method, an active printhead die observation method, a masking observation method, a dependency observation method, a random observation method, or other observation methods described herein.

Block 605 may be presented in the method as a determination where the ASIC (204) and other components of the printhead (108) determine whether a next printhead is to be observed and controlled. If a next printhead is not to be observed and controlled (block 605, determination NO), then the process may terminate. If, however, a next printhead is to be observed and controlled (block 605, determination YES), then the process may loop back to block 601, and observation and control of the next printhead die (109) takes place as described above in connection with blocks 601 through 605. The next printhead die (109) observed and controlled is chosen based on the observation scheme utilized by the RRSM (307).

Figure 7:
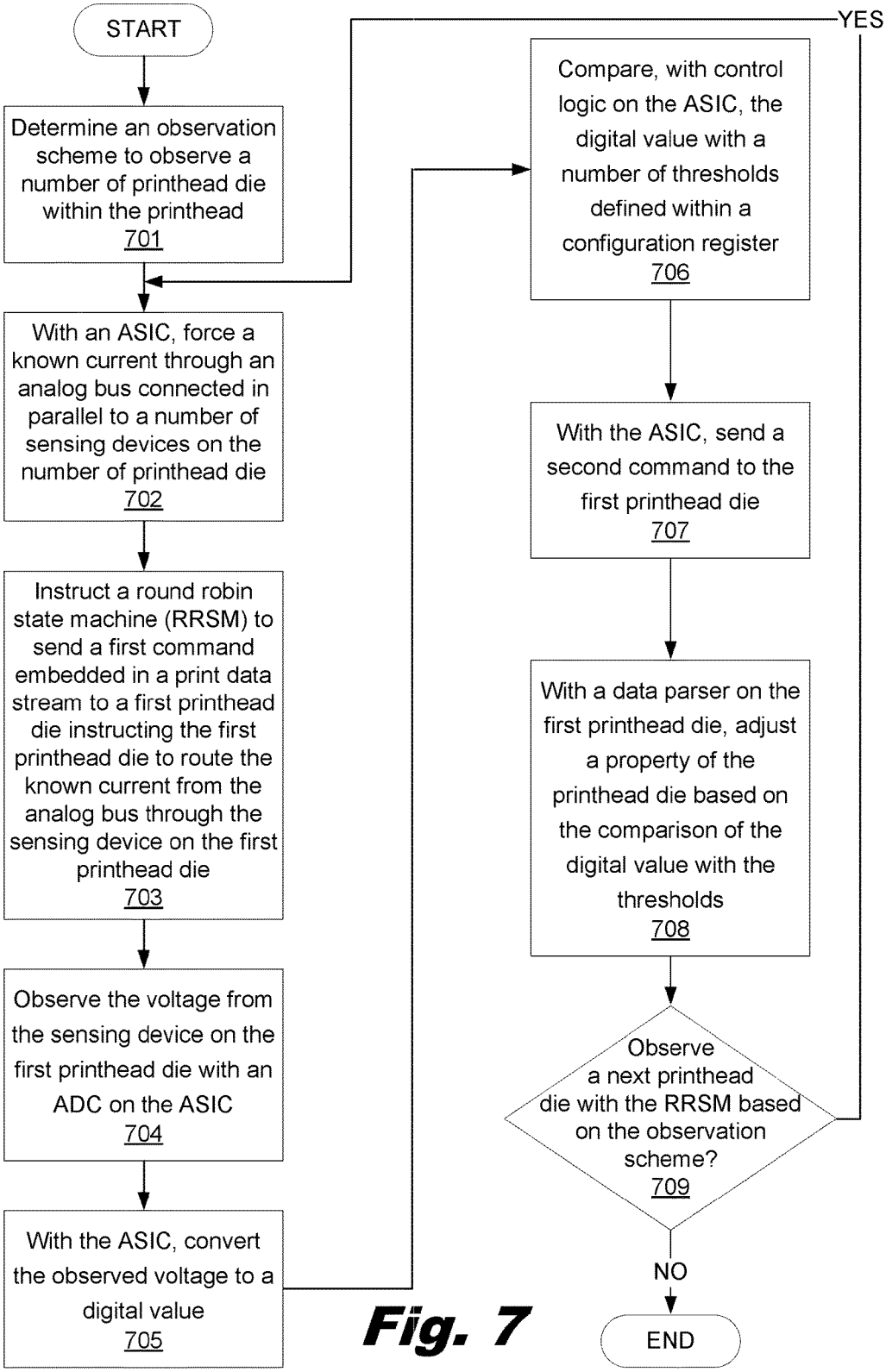
FIG. 7 is a flowchart showing a method of controlling temperatures within a plurality of printhead die, according to another example of the principles described herein.

FIG. 7 is a flowchart showing a method of controlling temperatures within a plurality of printhead die, according to another example of the principles described herein. As mentioned above, the method (700) may begin by determining (block 701) an observation scheme to observe a number of printhead die within the printhead. An observation scheme allows the method (700) to choose which printhead die (109) to analyze and control and in what order to do so. Choosing which printhead die to analyze and control may be a tradeoff between the computational cost in performing the analysis and control versus need to control a zone. Because each sensor, such as a temperature sensor, is addressed within the printhead (108), any observation scheme may be created.

The observation scheme may be based on the printhead die and its thermodynamics. Some portions of the printhead die may be more stable than other portions of the printhead die. Thus, the method (700) may concentrate readings at portions that are more dynamic such as the ends of the printhead die. A baseline characteristic for each of the printhead die (109) and the printhead (108) as a whole may be created that identifies the stable and dynamic portions of the printhead and individual printhead die. These observation schemes may include a round-robin observation method, an adaptive observation method, a depopulation observation method, an active printhead die observation method, a masking observation method, a dependency observation method, a random observation method, or other observation methods described herein.

The method (700) of FIG. 7 includes, with an ASIC, forcing (block 702) a known current through an analog bus connected in parallel to a number of sensing devices on the number of printhead die. In one example, the known current may be produced by the fixed current source of FIG. 3. As will be described below, the know current may be used to aid the method (700) in determine properties of a printhead die (109). As described above, the sensor excitation method may include any sensor excitation method that may use a shared sense bus model. Apart from applying a known current via the fixed current source (305), the printhead property control circuitry (110) may use a multiplexed sense voltage. In this example, the sense voltage may be generated internally by the printhead die (109). In another example, sensor excitation method may include use of a digital pulse width modulation (PWM) signal in connection with each printhead die (109).

The method (700) further includes instructing (block 703) a RRSM (307) to send a first command embedded in a print data stream via the analog bus (309) or sent via a dedicated control bus (510) to a first printhead die (109). The commend instructs the first printhead die (109) to route the known current from the analog bus (309) or control bus (510) through the sensing device (404) on the first printhead die (109). As mentioned above, sensors may be placed on the printhead die at each zone.

Observation (block 704) of the voltage from the sensing device on the first printhead die with an ADC (304) on the ASIC (204) takes place at block 704. As mentioned above, the ASIC (204) includes a number of ADCs (304) connected to the sensors (404) that control and read a number of resistors (403) coupled to the sensors, respectively, in a time multiplexed manner. The ADC (304) is used to capture an analog signal. In an example, the voltage received from the sensors is an analog signal.

As mentioned above, the method (700) further includes with the ASIC (204), converting (block 705) the observed voltage to a digital value. TADC digitally converts the observed analog voltage signal into an equivalent digital signal. In one example, the digital signal represents a temperature value.

The method (700) further includes comparing (block 706), with control circuitry (306) on the ASIC (204), the digital value with a number of thresholds defined within a configuration register (308). As mentioned above, the configuration register (308) may store, in memory, maximum thresholds and a minimum thresholds for each zone of a printhead die (109) with regard to properties of the printhead die. For example, if a printhead die includes three zones, the configuration registers store, in memory, maximum thresholds, and minimum thresholds for each of the three zones. The digital value produced by the ADC (304) for each zone is compared, via the control logic (306), to a maximum threshold and a minimum threshold defined in configuration register (308). As a result, the method (700) determines if the digital value is below a minimum threshold or above a maximum threshold.

At block 707, the method may continue by, with the ASIC, sending a second command embedded in the print data stream via the analog bus (309) or sent via the dedicated control bus (510) to the first printhead die. The second command may be used to adjust (block 708) a property of the printhead die (109) being observed based on the comparison of the digital value with the thresholds. The data parser (303, 402) may operate as described above. A property, such as a temperature, may be adjusted as described above.

The method (700) may further include determining (block 709) whether a next printhead is to be observed. If a next printhead is not to be observed and controlled (block 709, determination NO), then the process may terminate. If, however, a next printhead is to be observed and controlled (block 709, determination YES), then the process may loop back to block 701, and observation and control of the next printhead die (109) takes place as described above in connection with blocks 701 through 709. The next printhead die (109) observed and controlled is chosen based on the observation scheme utilized by the RRSM (307).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor (101) of the printing device (100) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a wide array printhead module that includes a plurality of printhead die. Each of the printhead die includes a number of sensors to measure properties of a number of elements associated with the printhead die. The wide array printhead module further includes an application specific integrated circuit (ASIC) to command and control each of the printhead die. The ASIC is located off any of the printhead die. This wide array printhead module may have a number of advantages, including: (1) a savings in cost of materials, design, and manufacturing of the printhead die by removing redundant sets of control circuitry from the plurality of printhead die; (2) allowing for higher precision property control circuitry on less expensive silicon dies such as he ASIC; (3) allowing for more configurability of the property control regime through the centralized ASIC; and (4) allowing for a number of observation schemes to be utilized including a depopulation scheme where observation of a number of sensors within a number of printhead die may be skipped to increase printhead die observation bandwidth, among other advantages.

The preceding description has been presented to illustrate and describe examples of the principles described. This description is not intended to be exhaustive or to limit these principles to any precise form disclosed. Many modifications and variations are possible in light of the above teaching.

What is claimed is:

1. A wide array printhead module comprising:

a plurality of printhead die, each of the printhead die comprising:

a number of sensors to measure properties of a number of elements associated with the printhead die;

an application specific integrated circuit (ASIC) to control the sensors to measure the properties of the elements of each of the printhead die, the ASIC being located off of any of the printhead die; and a pass gate and control logic for the pass gate to communicate a number of signals to the ASIC via a analog bus; and a bi-directional configuration bus to transmit a number of control signals to property control elements located on each of the plurality of printhead die.

2. The wide array printhead module of claim 1, in which the ASIC comprises:

a number of analog-to-digital converters (ADC); and

ADC configuration and control (C&C) logic, in which the ADC and ADC C&C logic measure and control the properties of each of the printhead die.

3. The wide array printhead module of claim 1, in which the number of signals are sent by the ASIC as time multiplexed signals between the plurality of printhead die to control the elements and measure the properties of the elements in zones of each of the printhead die.

4. The wide array printhead module of claim 1, in which the ASIC further comprises:

a round robin state machine (RRSM) to determine which of the number of printhead die is being observed and controlled with regard to the properties of the printhead die, in which the signals sent by the RRSM observes and controls the properties of the printhead die based on a number of observation schemes.

5. A printing device comprising:

wide array printhead module comprising:

a plurality of printhead die, the plurality of printhead die comprising a number of sensors to measure properties of a number of elements associated with the plurality of printhead die; and an application specific integrated circuit (ASIC) to command and control each of the printhead die, the ASIC being located off of any of the printhead die and coupled to all printhead die in parallel;

in which the ASIC commands and controls the printhead die in a time multiplexed manner between the printhead die, and in which each of the printhead die further comprise a pass gate and control logic for the pass gate to communicate a number of signals to the ASIC.

6. The printing device of claim 5, in which the ASIC comprises:

a number of analog-to-digital converters (ADC); and

ADC configuration and control (C&C) logic, in which the ADC and the ADC C&C logic measure and control properties of each of the printhead die.

7. The printing device of claim 5, in which the printhead further comprises a bi-directional configuration bus to transmit a number of control signals to property control elements located on each of the plurality of printhead die.

8. The printing device of claim 5, in which the ASIC further comprises:

a round robin state machine (RRSM) to:

determine which of the number of observation schemes to use to observe and control the plurality of printhead die with regard to properties of the plurality of printhead die; and measure and control the properties of the printhead die in based on the observation scheme.

9. A method of controlling properties of a plurality of printhead die within a wide array printhead module, comprising:

with a round robin state machine (RRSM) within an application specific integrated circuit (ASIC) located off any of the printhead die:

sending a signal to a first one of the printhead die to determine properties of the first printhead die via a number of first sensing devices on the first printhead die;

with an analog-to-digital converter (ADC) located on the ASIC, converting an observed property received from the first sensing devices to a digital property value;

with control logic, comparing the digital property value to a number of thresholds defined in a configuration register; and adjusting the properties of the first printhead die based on the digital property value and the thresholds; and controlling the properties within a next printhead die based on an observation scheme.

10. The method of claim 9, in which sending the signal to the first printhead die to determine the properties of the printhead die comprises:

with the ASIC, applying the information as a known current onto an analog bus, in which the analog bus couples the plurality of the printhead die to the ASIC in which the ASIC is connected in parallel with all of the plurality of printhead die.

11. The method of claim 10, in which all other printhead die are disconnected from the analog bus via a number of pass gates associated with each of the printhead die during sending of the signal to the first printhead die.

12. The method of claim 9, in which adjusting the properties of the first printhead die based on the digital property value and the threshold comprises:

if the digital property value is lower than the minimum threshold or above the maximum threshold for a first of a number of zones of the first printhead die, with the ASIC, sending a command to a number of property control elements associated with the first zone to control the properties of the first printhead die in the first zone.

13. The method of claim 9, in which:

sending the signal to the first one of the printhead die to determine properties of the first printhead comprises sending the signal over a analog bus in a time multiplexed manner relative to the control of the next printhead die; and adjusting the properties of the first printhead die based on the digital property value and the threshold comprises sending a command to the printhead die to adjust a temperature of at least a portion of the printhead die via a bi-directional configuration bus.

* * * * *